US010639535B2

(12) United States Patent
Hoover

(10) Patent No.: US 10,639,535 B2
(45) Date of Patent: May 5, 2020

(54) ATHLETIC HANDS TRAINING APPARATUS

(71) Applicant: Tim Alan Hoover, Arlington, TX (US)

(72) Inventor: Tim Alan Hoover, Arlington, TX (US)

( * ) Notice: Subject to any disclaimer, the term of this patent is extended or adjusted under 35 U.S.C. 154(b) by 194 days.

(21) Appl. No.: 15/655,780

(22) Filed: Jul. 20, 2017

(65) Prior Publication Data

US 2018/0021650 A1 Jan. 25, 2018

Related U.S. Application Data

(60) Provisional application No. 62/364,693, filed on Jul. 20, 2016.

(51) Int. Cl.

| | |
|---|---|
| ***A63B 69/20*** | (2006.01) |
| ***A63B 69/00*** | (2006.01) |
| ***A63B 71/02*** | (2006.01) |

(52) U.S. Cl.

CPC ..... *A63B 69/20* (2013.01); *A63B 69/004* (2013.01); *A63B 2071/026* (2013.01)

(58) Field of Classification Search

CPC .. A63B 69/20; A63B 69/004; A63B 2071/026
See application file for complete search history.

(56) References Cited

U.S. PATENT DOCUMENTS

| | | | | |
|---|---|---|---|---|
| 2,435,864 | A | 2/1948 | Adams | |
| 3,250,533 | A | 5/1966 | Nicholson, II | |
| 4,077,624 | A | 3/1978 | Feaser | |
| 4,088,315 | A | 5/1978 | Schemmel | |
| 4,494,662 | A | 1/1985 | Clymer | |
| 4,564,192 | A | 1/1986 | Lebowitz | |
| 4,593,900 | A | 6/1986 | Burke | |
| 4,817,941 | A * | 4/1989 | McCorry | A63B 69/004 482/87 |
| 4,946,159 | A | 8/1990 | Jones | |
| 5,342,267 | A | 8/1994 | Adams et al. | |
| 5,389,057 | A | 2/1995 | Zagata, Jr. | |
| 5,540,641 | A | 7/1996 | Williams et al. | |
| 5,554,088 | A * | 9/1996 | Zlojutro | A63B 69/004 482/83 |
| 5,679,103 | A | 10/1997 | Pratchett | |
| 5,700,230 | A | 12/1997 | Cardona | |
| 5,722,920 | A | 3/1998 | Bauer | |
| 5,899,835 | A | 5/1999 | Puranda | |
| 6,896,630 | B1 * | 5/2005 | Breining | A63B 69/0002 473/422 |
| 7,297,092 | B1 | 11/2007 | Gaynor | |
| 7,938,759 | B1 | 5/2011 | Gaynor | |
| 8,348,815 | B2 | 1/2013 | Signorino | |

(Continued)

FOREIGN PATENT DOCUMENTS

WO 2014041371 A1 3/2014

*Primary Examiner* — Sundhara M Ganesan
(74) *Attorney, Agent, or Firm* — Jack D. Stone, Jr.; Scheef & Stone, L.L.P.

(57) ABSTRACT

An athletic training support structure includes a post configured to extend substantially vertically. At least one horizontal arm is rotatably mounted on the post, so that the at least one horizontal arm extends substantially perpendicularly from the post and rotates in a substantially horizontal plane. A vertical arm may be rotatably mounted to an end of a horizontal arm for rotation in a substantially vertical plane.

12 Claims, 10 Drawing Sheets

(56) References Cited

U.S. PATENT DOCUMENTS

| | | | | |
|---|---|---|---|---|
| 8,617,034 | B2 * | 12/2013 | Eem | A63B 69/203 482/83 |
| 8,777,818 | B1 | 7/2014 | Tate, Jr. | |
| 9,744,420 | B1 * | 8/2017 | Bergamini | A63B 69/004 |
| 9,839,827 | B1 * | 12/2017 | Roberts | A63B 23/12 |
| 2004/0176222 | A1 | 9/2004 | Mitchell | |
| 2004/0224826 | A1 | 11/2004 | O'Shea | |
| 2005/0124469 | A1 | 6/2005 | Melvin | |
| 2005/0181913 | A1 | 8/2005 | Vang et al. | |
| 2005/0272569 | A1 | 12/2005 | Haeffer | |
| 2006/0025284 | A1 | 2/2006 | Livingstone et al. | |
| 2006/0058158 | A1 | 3/2006 | McAvoy | |
| 2007/0117689 | A1 | 5/2007 | MacKay et al. | |
| 2007/0167297 | A1 | 7/2007 | Stevenson | |
| 2008/0119335 | A1 | 5/2008 | Luigi | |
| 2010/0179031 | A1 | 7/2010 | Luigi | |
| 2011/0245038 | A1 | 10/2011 | Chiu et al. | |
| 2012/0129660 | A1 | 5/2012 | Eem | |
| 2013/0231223 | A1 | 9/2013 | Scully et al. | |
| 2014/0274588 | A1 | 9/2014 | Nelson | |

* cited by examiner

ATHLETIC HANDS TRAINING APPARATUS

CROSS-REFERENCE TO RELATED APPLICATIONS

This application claims the benefit of U.S. Provisional Application No. 62/364,693, filed Jul. 20, 2016, which application is hereby incorporated herein by reference, in its entirety.

TECHNICAL FIELD

The invention relates generally to an athletic hands training apparatus and, more particularly, to an athletic hands training apparatus that increases hand speed, hand-eye coordination, reaction response, timing, agility, and awareness.

BACKGROUND

Athletes are required to use their hands as a part of their respective sport of interest. Therefore, athletes often do not possess the skill set to effectively and efficiently use their hands in a manner conducive to their respective sport.

Conventional methods for athletes to achieve these skills for increasing hand speed, hand-eye coordination, reaction and reflex time, agility, and awareness, and effective use of hand techniques, are mostly based on stationary training tools and/or objects and offer no recoil from the athletes' motion. Conventional methods often also require personnel to hold a training tool while the athlete uses it.

In view of the foregoing, what is needed is an athletic hands training apparatus that enables an athlete to develop hand speed, hand-eye coordination, reaction and reflex time, agility, and awareness. It would be desirable if the athlete could train alone, without the assistance of another person, such as a trainer or coach. It would also be desirable for this training apparatus to provide directional motion to train and to hit the athlete back. Still further, it would be desirable if multiple athletes could use the training apparatus at the same time.

SUMMARY

The present invention, accordingly, provides an athletic training apparatus comprising a support structure having a post configured to extend substantially vertically. "Arms" may be rotatably mounted onto the post in such manner that a trainee (athlete) may hit them and the arm spin around and hit the trainee if the trainee does not react quickly enough and hit it again. One or more such arms of varying types may be rotatably mounted to the post in any combinations as desired. For example, a single horizontal arm includes a tee that may be rotatably mounted on the post, wherein a first tube extends from an opening in the tee. A double horizontal arm including a cross may be rotatably mounted on the post, wherein a second tube extends from each of two opposing openings in the cross. A single horizontal arm including a tee may be rotatably mounted on the post, wherein a third tube extends from an opening in the tee, and a double vertical arm having a first cross is mounted on an end of the third tube, wherein a fourth tube extends from each of two opposing openings in the first cross. A double horizontal arm including a second cross may be rotatably mounted on the post, wherein a fifth tube extends from each of two opposing openings in the second cross, and wherein a third cross is rotatably mounted on an end of each fifth tube, and a sixth tube extends from each of two opposing openings of each of the third crosses.

In use, an athlete uses his hands to hit the arms of the apparatus and, in response, the arms spin. As the arms spin, they return to the athlete on the other side of the post, requiring the athlete to react by quickly hitting them again, or be hit himself by the arms. Such action and reaction may continue as long as desired by the athlete.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
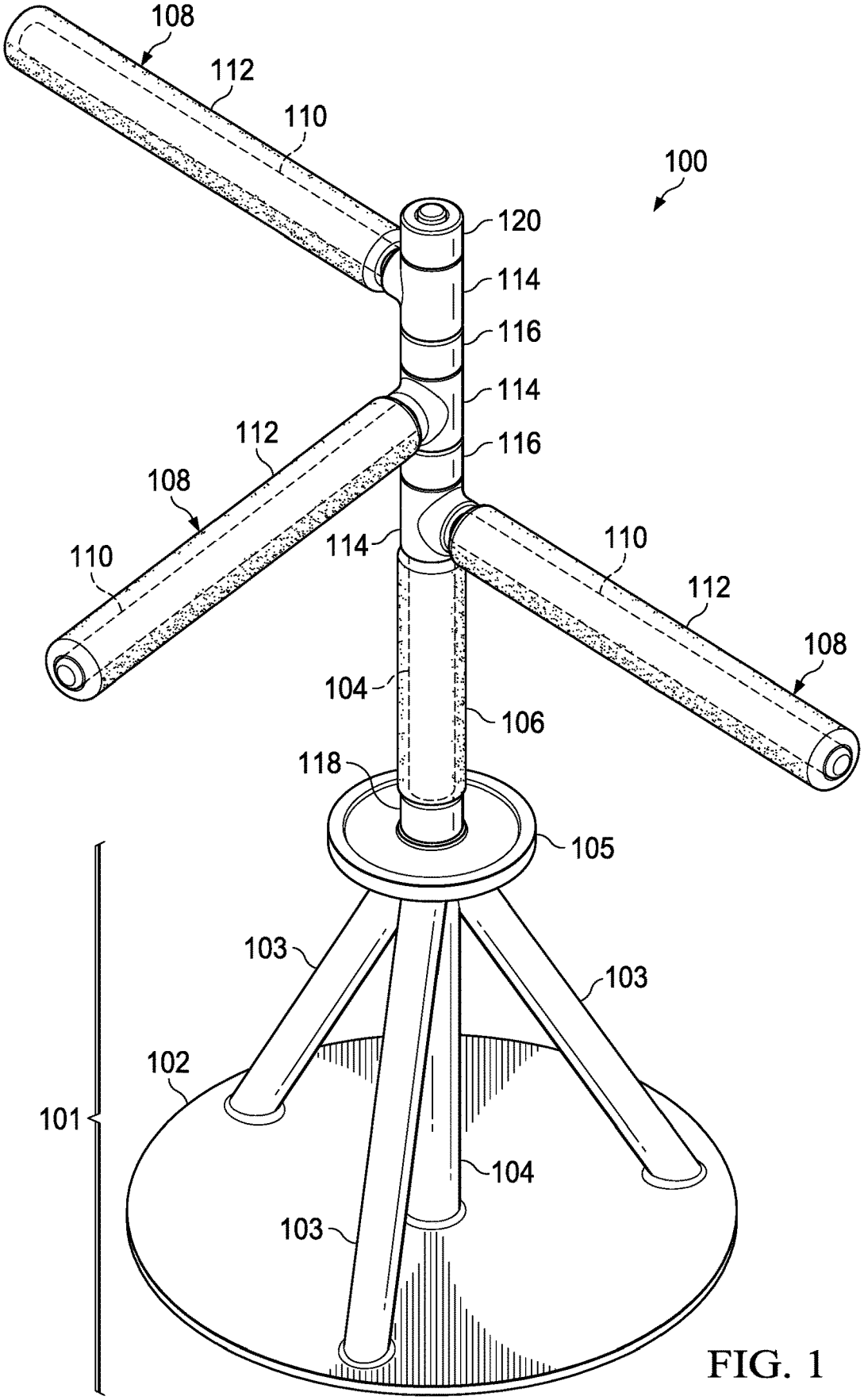
FIG. 1 is a perspective view of an athletic hands training apparatus embodying features of the present invention.

Refer now to the drawings wherein depicted elements are, for the sake of clarity, not necessarily shown to scale and wherein like or similar elements are designated by the same reference numeral through the several views. The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein. Additionally, as used herein, the term "substantially" is to be construed as a term of approximation.

For definitional purposes, the following terms will be used for referring to the fully assembled apparatus in normal use. The term "horizontal" refers to the direction parallel to a surface on which the assembled training apparatus is supported in normal use. The term "vertical" refers to a direction substantially perpendicular to the horizontal direction. The term "base" refers to the end of the apparatus closest to the surface on which the apparatus is supported. The term "top" refers to the end opposite the base.

Figure 12:
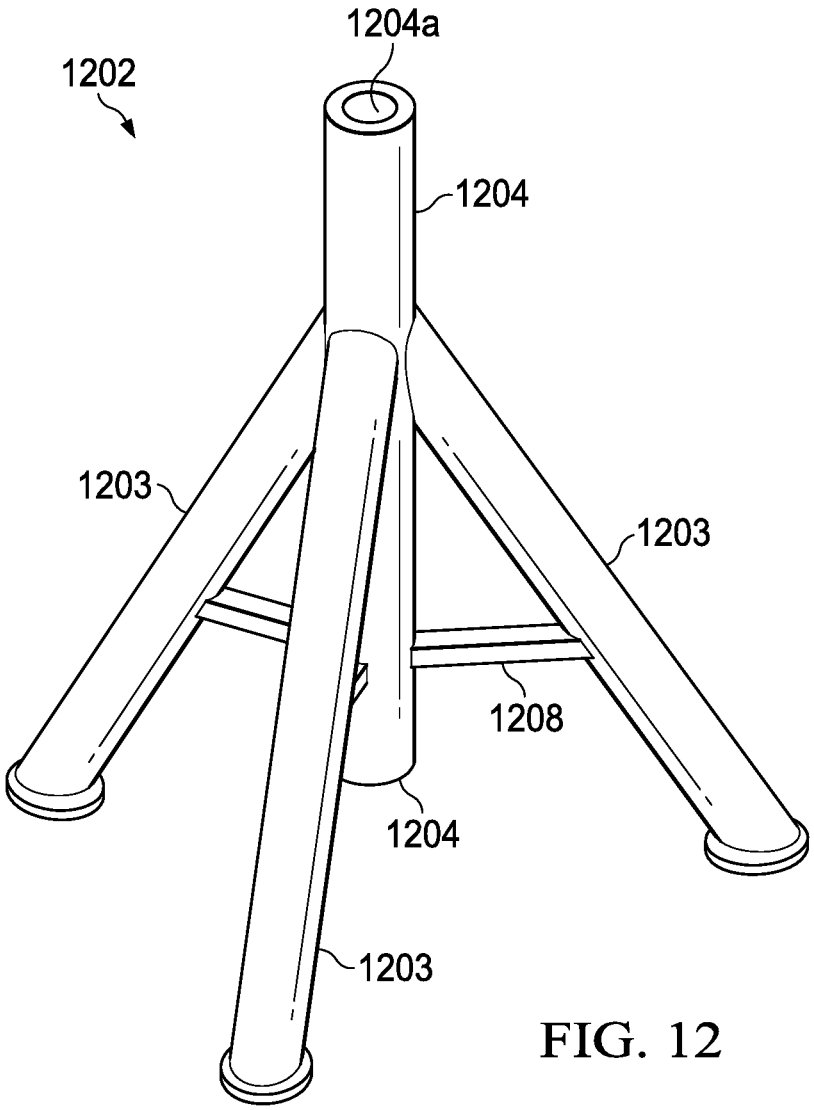
FIG. 12 exemplifies an alternate base stand adaptable for supporting the apparatus of the invention.

Referring to FIG. 1 of the drawings, the reference numeral 100 generally designates an athletic hands training apparatus embodying features of the present invention. The system 100 includes a base stand 101 having a base plate 102 and a post 104 attached to the base and extending generally upwardly. The post 104 is preferably a steel tube which is reinforced with three legs 103, and preferably extends to the top of the apparatus. A stabilizing weight 105, such as a conventional barbell weight, is preferably positioned on post 104, resting on the tops of legs 103 to stabilize the apparatus. Various modifications to the disclosed base stand 101 will be readily apparent to those skilled in the art. For example, post 104 could be fabricated from wood, aluminum, plastic, or any suitable material. Base 101 could be configured as shown in FIG. 12, discussed below.

A sleeve 118 (which may be referred to as a spacer or bushing) is preferably positioned on post 104 on top of weight 105. Sleeve 118 is configured having a length suitable for positioning arms 112 (discussed below) at an appropriate height for an athlete to hit the arms. Sleeve 118 is preferably wrapped in a foam padding 106 that is preferably wrapped in fabric, leather, or the like (not shown).

Each of at least one "horizontal" arm 108, three of which are shown, includes a tee 114 rotatably mounted on post 104, atop sleeve 118, and a tube 110 extending from an opening of tee 114. Each tee 114 and tube 110 is preferably fabricated from a lightweight material, such as polyvinyl chloride ("PVC"). Tube 110 is preferably wrapped in any suitable foam padding 112, which is preferably wrapped in a covering (not shown) such as leather or fabric. Spacers (aka bushings) 116 may optionally be inserted between tees 114 to space out arms 108 as desired. An upper stop 120, such as a clamp, coupling, or the like, is preferably secured on post 104 above the uppermost tee 114 mounted on post 104.

Figure 2:
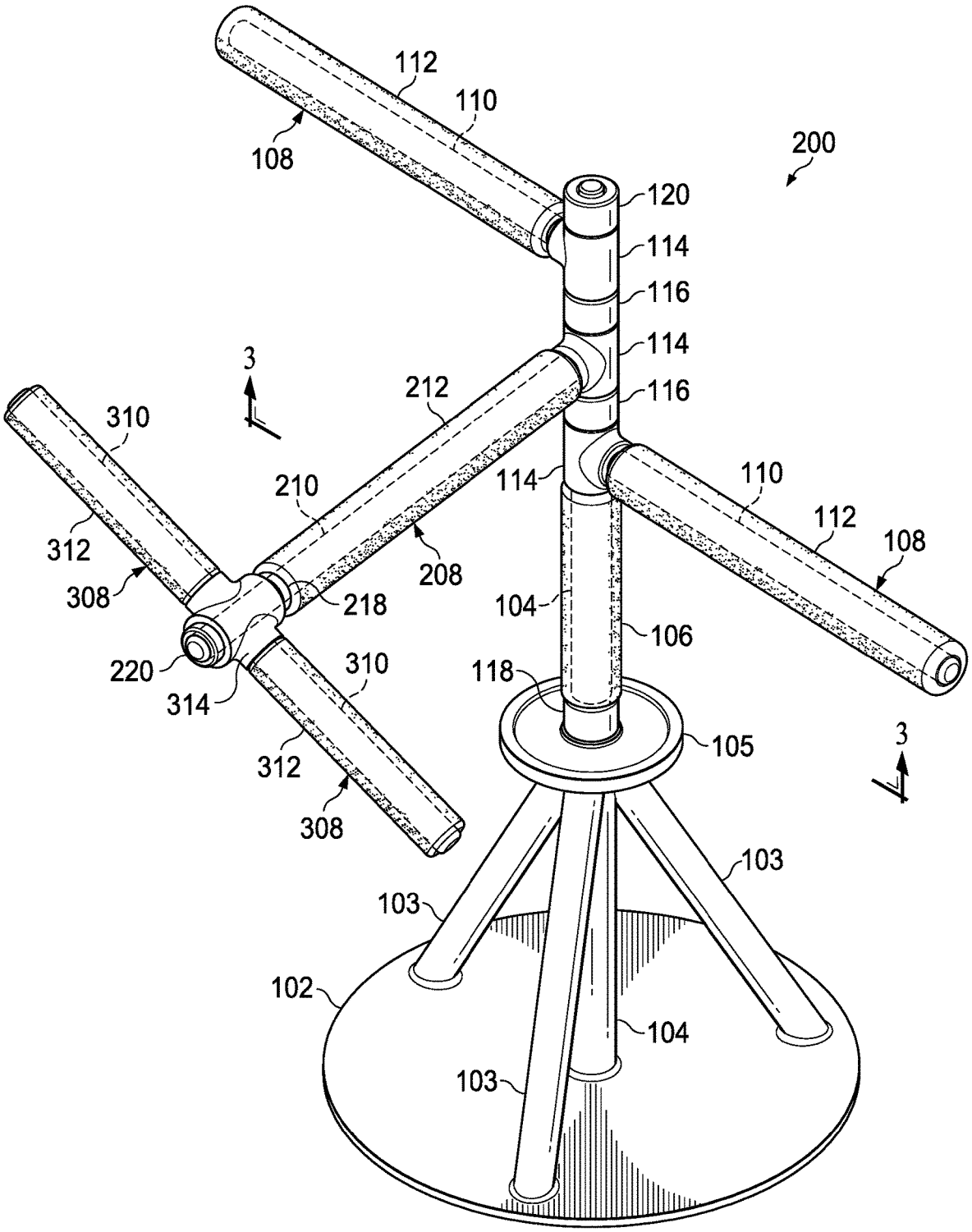
FIG. 2 is an alternate embodiment of the athletic hands training apparatus of FIG. 1.

FIG. 2 exemplifies an alternate embodiment of the invention wherein a "vertical" arm 308 is rotatably mounted to an end of a "horizontal" arm 208. Arms 108 and 208 are referred to herein as "horizontal" as they are rotatable in a substantially horizontal plane. In contrast, arm 308 is referred to herein as a "vertical" arm as it is rotatable in a substantially vertical plane. Arm 208 is similar to arm 108, arm 208 having a tube 210 preferably wrapped in a foam padding 212 covered in leather, fabric or the like (not shown). Arm 208, however, is longer than arms 108 (1) so that vertical arm 308 does not interfere with arms 108 when arm 308 spins, and (2) so that arm 308 may be mounted to the end of arm 208.

Figure 3:
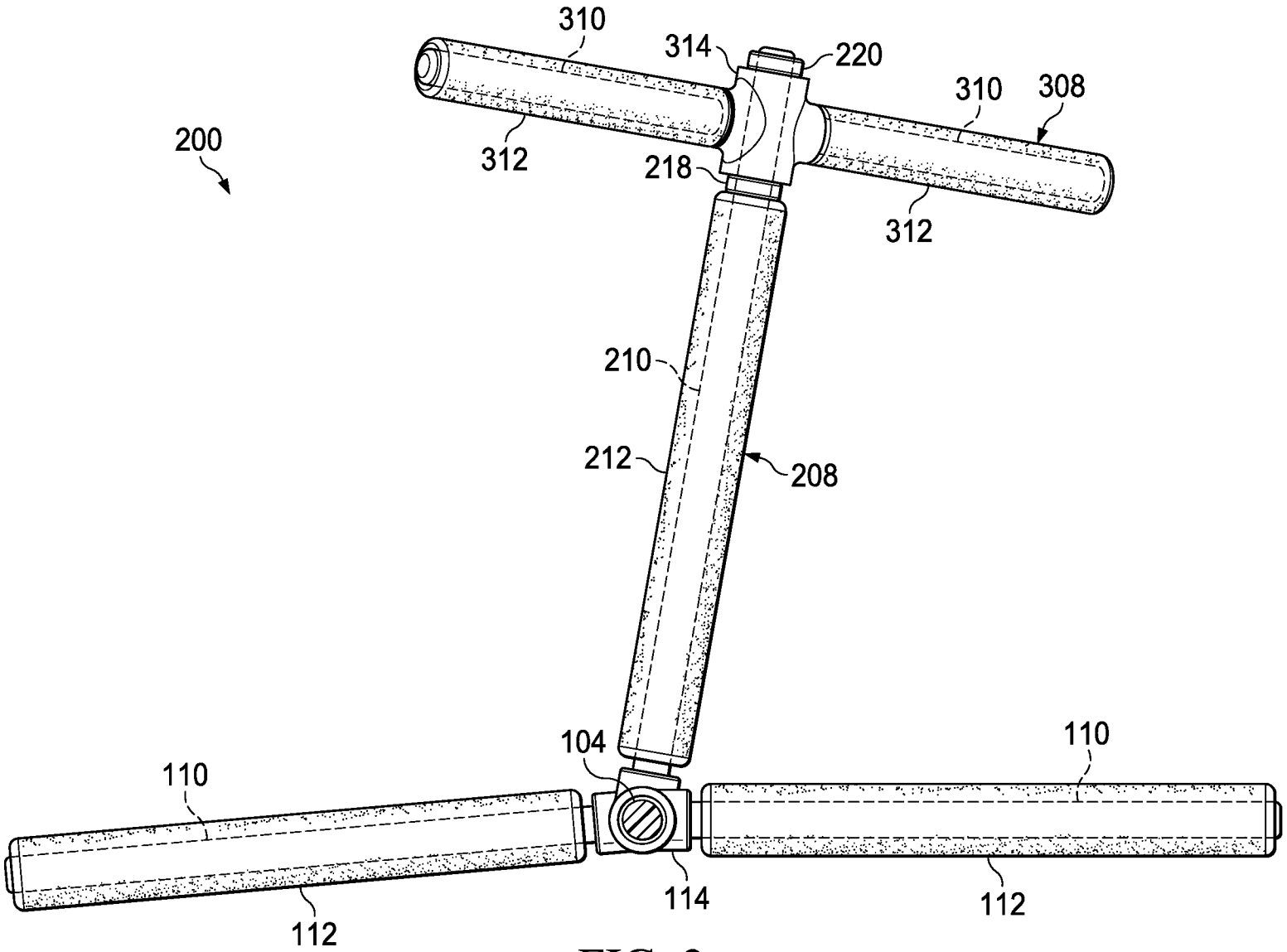
FIG. 3 is a view of the apparatus of FIG. 2 taken according to the line 3-3 of FIG. 2.

With reference to both FIGS. 2 and 3, arm 308 includes two tubes 310 extending in substantially opposite directions from a four-way cross 314. Cross 314 is mounted on an end of tube 210 and secured thereto between two clamps (or the like) 218 and 220. Tubes 310 are preferably wrapped in foam padding and further preferably wrapped in leather, fabric, or the like (not shown).

Figure 4:
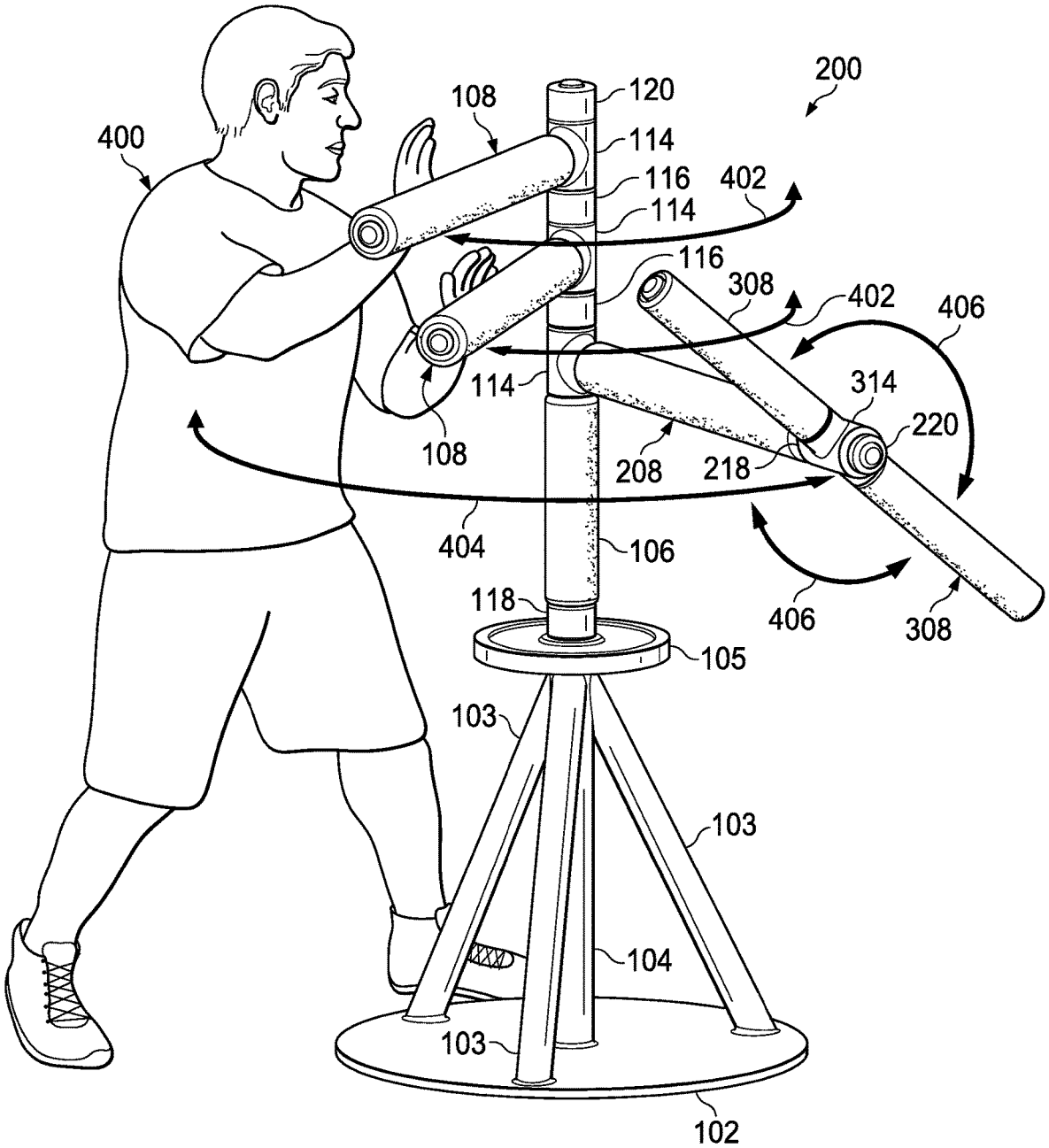
FIG. 4 exemplifies use of the apparatus such as that of FIG. 2.

Operation of the athletic hands training apparatus is exemplified in FIG. 4. As shown, an athlete 400 uses his hands to hit arms 108, 208, and 308. In response, arms 108 spin as indicated by arrows 402, arms 208 spin as indicated by arrows 404, and arms 308 spin as indicated by arrows 406. As the arms spin, they return to the athlete on the other side of post 104, requiring the athlete to react by quickly hitting them again, or be hit himself by the arms. Such action and reaction may continue as long as desired by the athlete.

Figure 5:
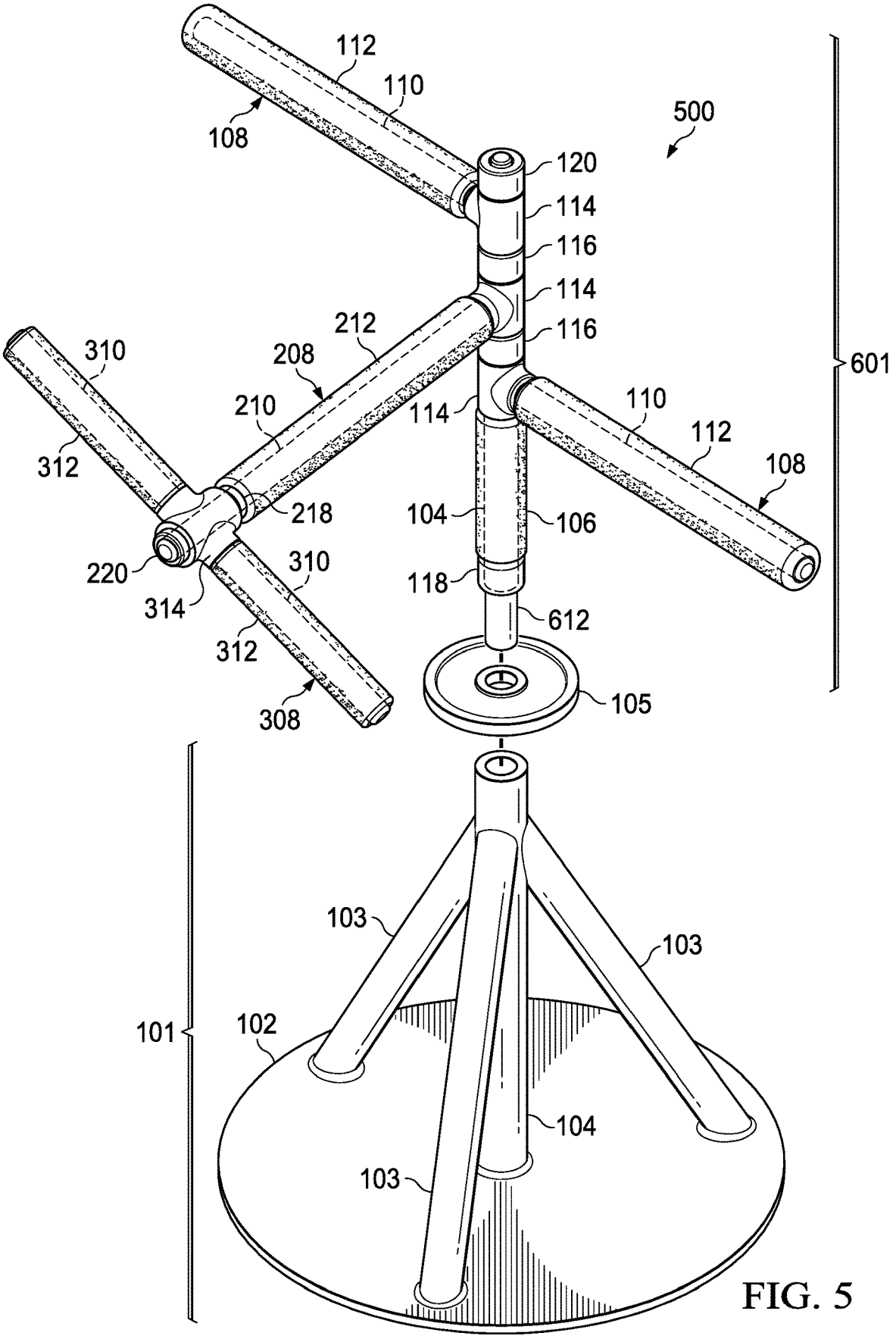
FIG. 5 exemplifies a separable apparatus embodying features of the present invention.

FIG. 5 exemplifies an alternate embodiment 500 of the invention wherein the base 101 is detachably separable from the assembly of arms 601. This provides a number of advantages to the apparatus. For example, the apparatus 500 may be transported more compactly when the base 101 is detached from the arms 601. In another example, base 101 may be switched out for another base, such as shown in FIG. 12, or converted for handheld use, as discussed below with respect to FIG. 6.

Figure 6:
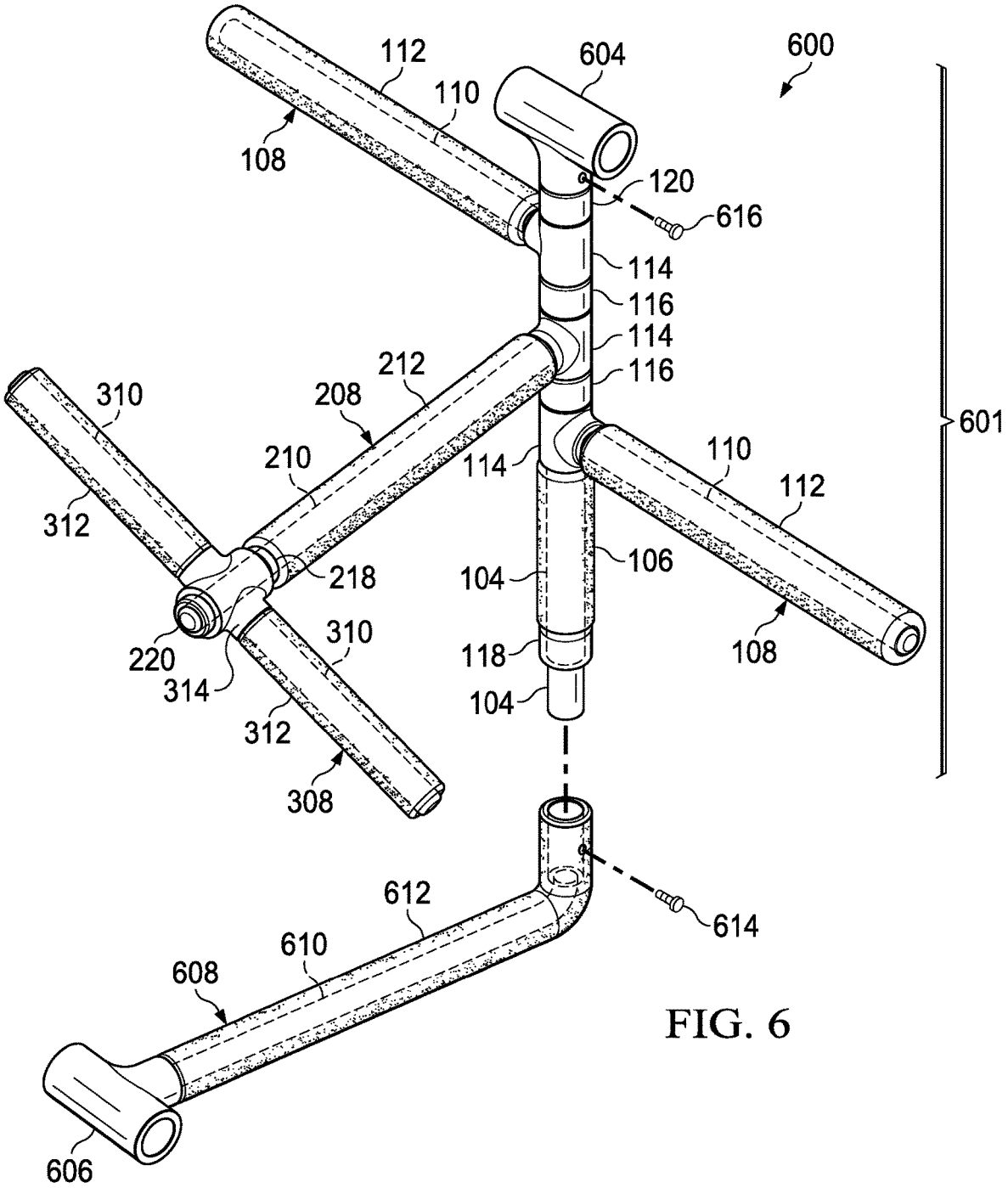
FIG. 6 exemplifies an alternate embodiment of the athletic hands training apparatus of FIG. 1 which is handheld.

FIG. 6 exemplifies a still further advantage of enabling base 101 to detach from arms 601 discussed above with respect to FIG. 5. Specifically, the apparatus 600 may be converted to a handheld unit by attaching a tee 604 for use as an upper handle atop the apparatus, and securing it thereto with a fastener 616 such as a screw or a bolt and wingnut. Base 101 is replaced with a handle extension 608 having a lower tee 606 for use as a lower handle extending from an end of extension 608, and securing extension 608 thereto with a fastener 614 such as a screw or a bolt and wingnut. Handle extension 608 should be longer than the longest arm mounted to the apparatus 500 to avoid interference with the arms in use. Handle extension 608 includes a tube 610 and is preferably wrapped in padding 612. Post 104 may be shortened as desired for handheld use. For the handheld unit 600 (and 700 discussed below with respect to FIG. 7), post 104 is preferably fabricated from wood, but may be fabricated from any suitable material such as steel, aluminum, plastic, or the like. In use, one person (e.g., a trainer) supports the apparatus by grasping the lower and upper tees (handles) 604 and 606 with his (or her) two hands, while a second person (e.g., a trainee/athlete) acts and reacts to hit the arms 108, 208, and 308 with his hands, as discussed above with respect to use of the embodiment of FIG. 4.

Figure 7:
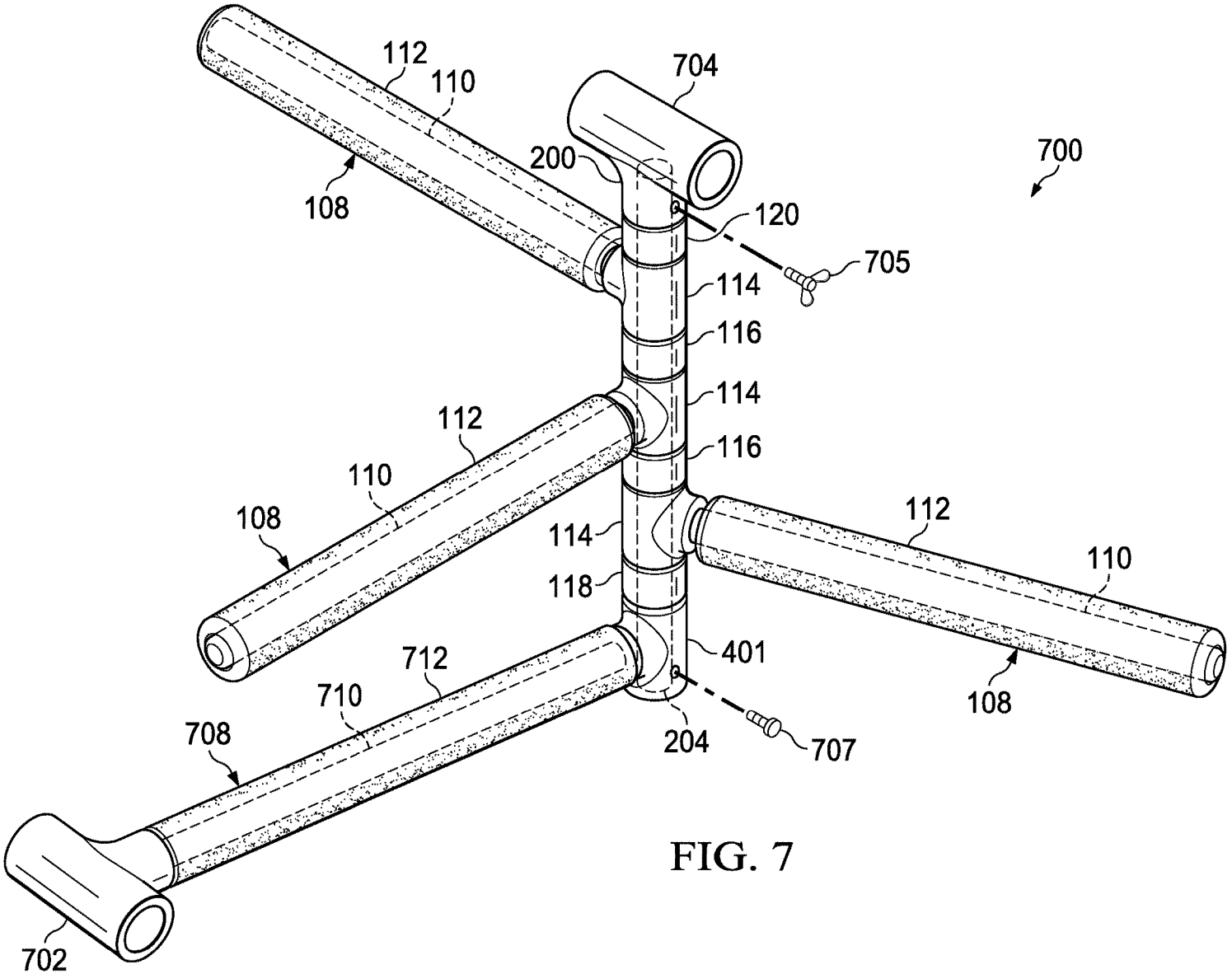
FIG. 7 exemplifies an alternate embodiment of the apparatus of FIG. 6.

FIG. 7 exemplifies a variation 700 in the embodiment of FIG. 6, wherein post 104 is shortened, making the apparatus lighter and easier to control. Further, a tee 401 is secured to a lower end of post 104 and secured thereto with a fastener 707, such as a screw or bolt with wingnut. An extension 708 having tube 710 and padding 712 extends from tee 401, and includes a tee 702 at an end for use as a lower handle. A tee 704 is positioned atop post 104 for use as an upper handle, and is preferably secured thereto with a fastener 705, such as a screw or bolt with a wingnut. Extension 708 should be longer than the longest arm mounted to the apparatus 700 to avoid interference with the arms in use. As with apparatus 600, in use, one person (e.g., a trainer) supports the apparatus by grasping the lower and upper tees (handles) 702 and 704 with his (or her) two hands, while a second person (e.g., a trainee/athlete) acts and reacts to hit the arms, exemplified as arms 108, with his hands as discussed above with respect to use of the embodiment of FIG. 4.

Figure 8:
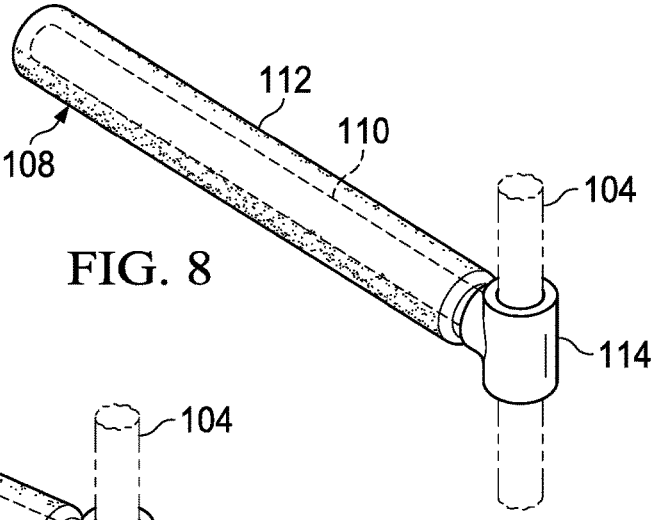
FIG. 8 exemplifies a single horizontal arm adaptable for use with the present invention.

FIGS. 8-11 depict four arm configurations adaptable for use with the apparatus. Any of the arms of FIGS. 8-11 may be mounted as desired onto post 104 in any desirable sequence. FIG. 8 depicts a single horizontal arm 108 rotatable in a substantially horizontal plane as described above. Arm 108 includes a tee 114 having a tube 110 extending from a central (or outlet) opening thereof. Tee 114 is configured for being rotatably mounted on post 104. The tube may be joined to the tee in any conventional manner, such as by threads or adhesive. Tee 114 is preferably a straight tee in which each opening is the same size. Tee 114 and tube 110 are preferably fabricated from a lightweight material, such as polyvinyl chloride (PVC). Tube 110 is preferably wrapped in a conventional foam padding 112, and the padding is further preferably wrapped in leather, fabric, or the like.

Figure 9:
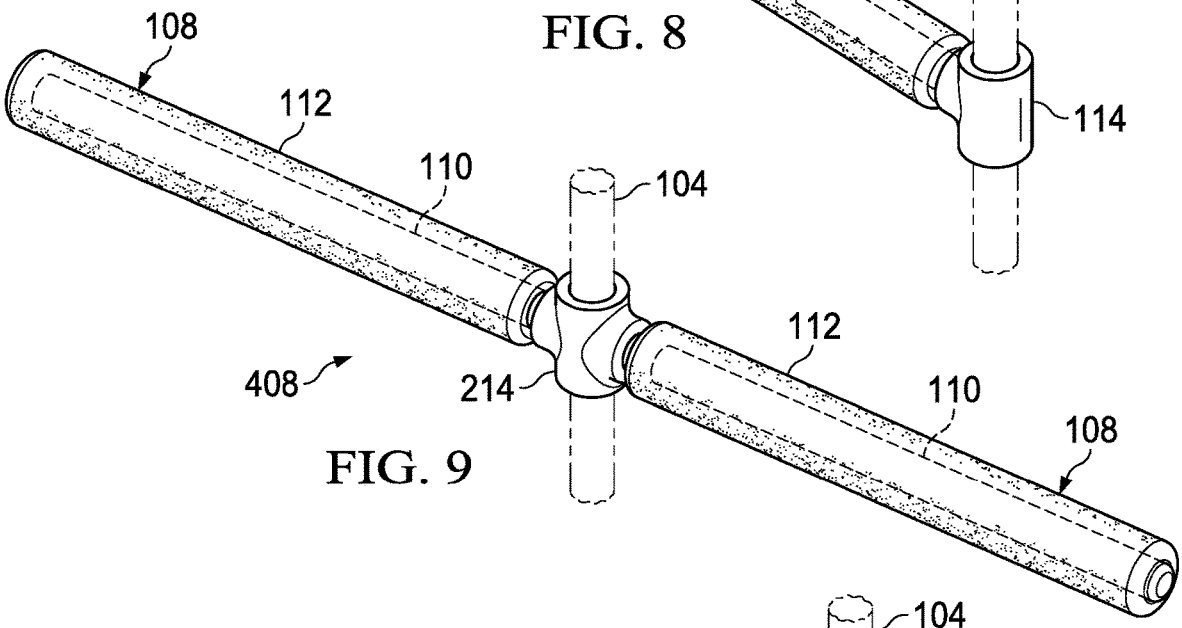
FIG. 9 exemplifies a double horizontal arm adaptable for use with the present invention.

FIG. 9 depicts a double horizontal arm 408 having a four-way cross 214 with a tube 110 extending from each of two opposing openings in cross 214 similar to how a tube 110 extends from tee 114 in FIG. 8. Cross 214 is configured for being rotatably mounted on post 104.

Figure 10:
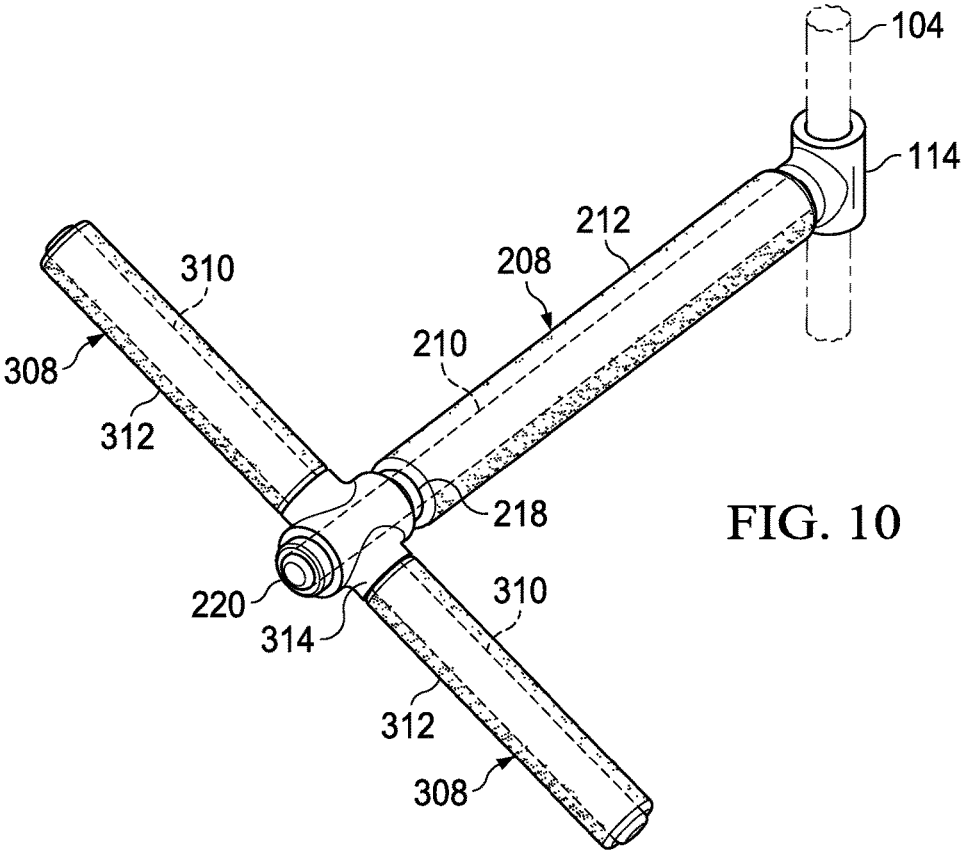
FIG. 10 exemplifies a single horizontal arm with vertical arms adaptable for use with the present invention.

FIG. 10 exemplifies a single horizontal arm 208 with a double vertical arm 308, as arm 308 is configured to rotate in a substantially vertical plane. Arm 208 includes a tube 210 (similar to tube 110) extending from a tee 114. Tube 210 is preferably wrapped in a foam padding 212, and the padding is further preferably wrapped in leather, fabric, or the like. At an end of tube 210, distal from tee 114, is double vertical arm 308 having a four-way cross 314 which is rotatably mounted and secured thereto between two clamps, or the like, 218 and 220. A tube 310 (similar to tube 110) extends from each of two opposing openings in cross 314, as in the embodiment of FIG. 9. Each tube 310 is preferably wrapped in a foam padding 312, and each padding is further preferably wrapped in leather, fabric, or the like.

Figure 11:
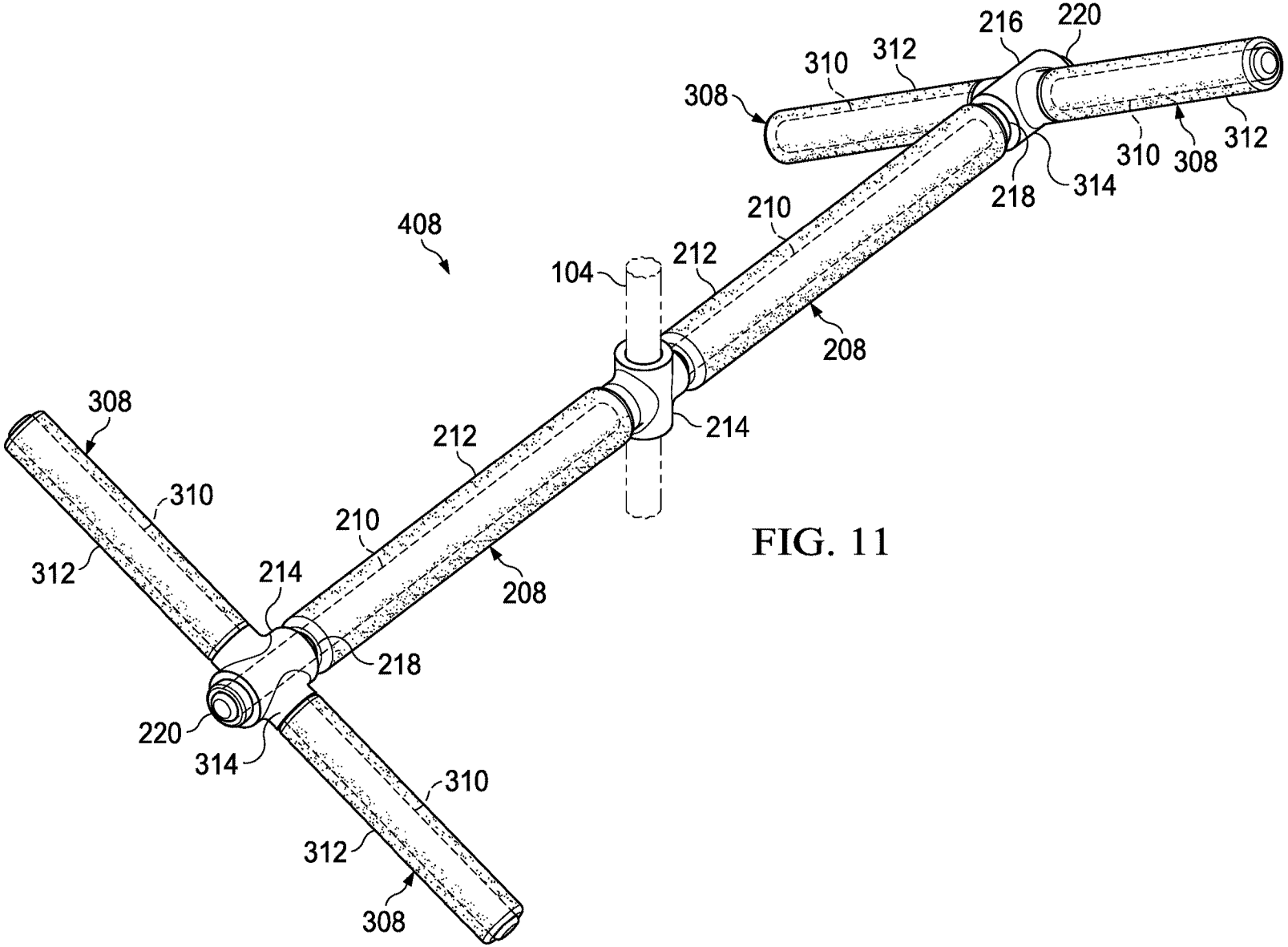
FIG. 11 exemplifies a double horizontal arm, each horizontal arm having vertical arms adaptable for use with the present invention.

FIG. 11 exemplifies a double horizontal arm 408, each of which arms 208 includes a double vertical arm 308. The embodiment of FIG. 11 is similar to the embodiment of FIG. 10, but for having a four-way cross 214, rather than a tee 114, rotatably mountable on a post 104, and arms 208 with vertical arms 308 secured to each of two opposing openings of cross 214.

Further to the discussion above, any of the arms of FIGS. 8-11 may be mixed and matched in any number as desired and mounted onto post 104 in any desirable sequence. Many examples of how arms may be combined have been depicted hereinabove, and by way of further example, but not limitation, three double arms as depicted by FIG. 9 may be combined on a training apparatus and has been found to be optimal for many athletes. The arms may also be mounted at any desirable height. For example, arms may be mounted lower (e.g., by removing sleeve 118) so that they may be used with the feet (e.g., in kicking), or they may be mounted low and high so that both hands and feet may be trained simultaneously.

The lengths of the arms 108, 208, 308, 408, and 708 may vary, depending on how fast it is desired that the arms move and react to being hit. The shorter the arm, the faster it moves and reacts to being hit. By way of example, but not limitation, a short arm may be twelve inches long, and a long arm may be fifteen inches. Twelve inch arms, in particular, have been found to be an optimum length for many athletes. Whenever vertical arms are positioned on the end of a horizontal arm, and such are combined with other horizontal arms, the other horizontal arms must be shorter than the horizontal arm with vertical arms attached thereto.

FIG. 12 exemplifies an alternate base 1202 that could be used to support the apparatus of the present invention. Base 1202 includes a tube 1204 supported by a tripod of legs 1203 and trusses 1208 in a manner well-known to those skilled in the art.

By the use of the present apparatus described herein, athletes may develop faster hand speed, better hand-eye coordination, improved reaction and reflex time, agility, and awareness. Further, the training apparatus enables athletes to train alone, without the assistance of another person, such as a trainer or coach. Still further, this training apparatus provides directional motion to train and to hit the athlete back. Still further, multiple athletes could use the training apparatus at the same time.

It is understood that the present invention may take many forms and embodiments. Accordingly, several variations may be made in the foregoing without departing from the spirit or the scope of the invention. For example, a tee could be replaced with a sleeve attached to an end of an arm, the longitudinal axis of the sleeve being substantially perpendicular to the longitudinal axis of the arm. Similarly, a cross may be replaced with a sleeve attached to the ends of two respective arms, the longitudinal axis of the sleeve being substantially perpendicular to the longitudinal axes of the arms. Caps may be applied to the ends of arms. A stop (rather than a spacer) may be attached to the post for supporting arms positioned above the stop. A target may be positioned on an arm to which an athlete would direct his hits. If spacers, such as spacers 116, are too large for post 104, then reducers may be used to to create a tighter fit with post 104. Bearings other than sleeve bearings, such as ball bearings, sleeve bearings, or the like, may be used between the tees and crosses that rotate on the post.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. An athletic training apparatus comprising:

a support structure having a post configured to extend substantially vertically; and a single horizontal arm including a tee rotatably mounted on the post and a first tube extending from an opening in the tee, and a double vertical arm having a cross mounted on the first tube, wherein a second tube extends from each of two opposing openings in the cross.

2. The athletic training apparatus of claim 1, wherein the support structure is a base stand.

3. The athletic training apparatus of claim 1, wherein the support structure is a base tripod structure.

4. The athletic training apparatus of claim 1, wherein the support structure includes an upper handle positioned atop the post, and a second handle extending from an extension extending from a lower end of the post.

5. The athletic training apparatus of claim 1, further comprising foam padding wrapped around at least a portion of at least one arm.

6. The athletic training apparatus of claim 1, further comprising a target positioned on at least one arm.

7. An athletic training apparatus comprising:

a support structure having a post configured to extend substantially vertically; and a double horizontal arm including a first cross rotatably mounted on the post and a first tube extending from each of two opposing openings in the first cross, and wherein a second cross is rotatably mounted on an end of each first tube and a second tube extends from each of two opposing openings of each of the second crosses.

8. The athletic training apparatus of claim 7, wherein the support structure is a base stand.

9. The athletic training apparatus of claim 7, wherein the support structure is a base tripod structure.

10. The athletic training apparatus of claim 7, wherein the support structure includes an upper handle positioned atop the post, and a second handle extending from an extension extending from a lower end of the post.

11. The athletic training apparatus of claim 7, further comprising foam padding wrapped around at least a portion of the double horizontal arm.

12. The athletic training apparatus of claim 7, further comprising a target positioned on the double horizontal arm.

* * * * *